US005607516A

United States Patent [19]

Asai

[11] Patent Number: 5,607,516

[45] Date of Patent: Mar. 4, 1997

[54] METHOD FOR EFFECTING CLEANING

[75] Inventor: Seiichi Asai, Tokyo, Japan

[73] Assignee: OA Care System Co., Ltd., Tokyo, Japan

[21] Appl. No.: 233,184

[22] Filed: Apr. 26, 1994

Related U.S. Application Data

[63] Continuation-in-part of Ser. No. 925,802, Aug. 4, 1992, abandoned.

[30] Foreign Application Priority Data

Nov. 28, 1991 [JP] Japan ..... 3-337962

[51] Int. Cl.[6] ..... B08B 5/04

[52] U.S. Cl. ..... 134/21; 134/26

[58] Field of Search ..... 134/21, 26

[56] References Cited

U.S. PATENT DOCUMENTS 4,381,951 5/1983 Baron ..... 134/29

4,604,144 8/1986 Wong ..... 143/29

OTHER PUBLICATIONS

*The American Heritage Dictionary*, Second College Edition, Houghton–Mifflin Co., Boston. 1985, pp. 94, 208, 387, and 982.

*Primary Examiner*—Melvyn Andrews
*Attorney, Agent, or Firm*—Oldham & Oldham Co., LPA

[57] ABSTRACT

A cleaning device and a method for effecting cleaning, in which a pretreatment agent is applied to a cloth affixed over a vertical surface of an erected body made of a rigid material, the pretreatment agent being adapted to improve the cleaning effect of a detergent, and then, the detergent is applied to the cloth, after which, all the pretreatment agent, detergent, and dirt are sucked and removed from the cloth. Hence, a high cleaning effect can be achieved without causing any deterioration of the cloth.

9 Claims, 2 Drawing Sheets

METHOD FOR EFFECTING CLEANING

CROSS REFERENCE TO RELATED APPLICATION

This application is a continuation-in-part of U.S. application of Seiichi Asai, Ser. No. 07/925,802, filed Aug. 4, 1992 now abandoned.

BACKGROUND OF THE INVENTION

1. Field of the Invention

The present invention relates to a device and a method for cleaning a cloth affixed on a partition used in an office for defining independent spaces in the office, or cleaning the one on a wall of a room.

2. Description of Prior Art

Hitherto, cleaning a carpet laid on a floor or floor surface has been effected by a mechanical agitation method, using a rotary brushing device, which involves spraying a cleaning water to the floor or carpet.

Incidentally, with regard to a partition used in an office for dividing its space or an interior wall in a room, it is often the case that their surfaces lie upright or vertical, and they are formed of a metallic panel, wooden panel, resin panel, and/or a mortar-plaster panel. A cloth is affixed over such elevated wall, serving a decoration purpose, a noise suppression purpose, or the like. FIG. 6 shows a typical example of structure of the partition or interior wall, in which are provided "a vertical wall body 50" made of rigid material and a "cloth 51" covering the vertical surface of the wall body 50.

To clean this sort of "cloth which covers the vertical surface of rigid elevated wall body" can, however, not be completed by the aforementioned mechanical agitation method, for the reason set forth below.

Firstly, a rotary brushing device used results in dispersing dusts or dirt only within the cloth (or within the fuzzy layer of carpet), so as to reduce an apparent dirty state therein, and therefore it is impossible to remove the dirt from the cloth or the like being cleaned. Thus, the cleaning itself is insufficient and insanitary, which may lead to deterioration of the cloth.

Secondly, use of the mechanical agitation by a rotary brushing device will forcibly raise the nap on cloth (woven fabric). This deteriorates the cloth significantly. (But, as for such a very fuzzy material as the woolen carpet, the mechanical agitation will not affect it so adversely and thus a large rotary brushing device has been used to clean that particular carpet.)

On the other hand, one can propose using a detergent-impregnated paper or cloth strip to wipe therewith the surface of cloth to be cleaned, in a frictional manner. Nonetheless, the frictional wiping has the problem that it will damage the cloth, and the dirt will remain in the cloth to a greater amount than normally acceptable.

Certainly, the foregoing mechanical agitation and wiping by detergent-impregnated medium will work effectively in the case of a cover cloth affixed over a cushion member made of a cotton or sponge material, as found in a seat or chair, because the dirt will leave from the cover cloth and be absorbed into the cushion member. But, this is not true with the above-stated "cloth affixed on a rigid elevated wall body", in which the presence of rigid wall body prevents such dirt escape from the cloth.

Further, the cloth on the partition in an office or a wall of a room is inevitably exposed for frequent contact with hands of persons, as a result of which a film of fat or oil is created upon the surface of the cloth. This fat or oil layer inhibits the cleaning activity of detergent as applied thereto, which however has never been perceived in the art of cleaning techniques.

For the reasons above, it has been commonly held impossible in this cleaning field to effectively clean such a "cloth affixed on a vertical wall body: as used on office partition boards, room walls or the like.

SUMMARY OF THE INVENTION

The present invention, therefore, has for its purpose the provision of an improved cleaning device and method for effecting the cleaning, which permits for effective cleaning of a cloth which is affixed over a vertical surface of a rigid erected body, such as the office partition or wall of a room, with a high cleaning effect, in a manner avoiding deterioration of the cloth.

According to the invention, the following advantages are produced:

- The cleaning effect can be improved, because a pretreatment agent is used to render the dirt easy to be decomposed and thereafter a detergent is used to remove the dirt from the cloth.
- Both detergent and dirt are sucked and removed from the cloth, thus providing a higher cleaning effect to this kind of cloth affixed over the vertical surface of a rigid erected body in a sanitary condition, and further preventing the cloth from developing a deterioration over a long period of time.
- There is no need to apply any forcible mechanical agitation to the cloth, which thus eliminates the necessity to raise the nap in the cloth, helping to prevent deterioration of the same during the cleaning.
- Spraying the pretreatment agent is done in a short time, with good efficiency, by means of a pretreatment agent spraying device having a pretreatment agent supplying pump of a motor operation type.
- Applying the detergent to the cloth and sucking both detergent and dirt thereon con be done in a short time, efficiently, by virtue of a detergent applying/sucking device being used, which includes a detergent applying pump and a sucking pump, both of which are a motor operation type.
- Use of the foregoing pretreatment agent spraying device for spraying the pretreatment agent onto the cloth, and subsequent use of the foregoing detergent applying/sucking device for sucking both detergent and dirt form the cloth, will reduce the time for cleaning the cloth and raise its efficiency.
- After having sprayed the pretreatment agent onto the cloth by the foregoing pretreatment agent spraying device, an operator can manipulate both the detergent applying nozzle and sucking nozzle by holding a grip provided with the detergent applying/sucking device, to thereby simultaneously effect the detergent applying and sucking operations. These two nozzles are provided at the grip. Thus, it is possible to easily clean the vertical surface, such as the partition or wall, with much efficiency.
- A brightening agent may be added in the detergent to prevent the luster reduction of the cloth due to the cleaning.

An alkaline chemical or agent may be added in the detergent to enhance the cleaning of the detergent.

The present invention basically comprises:

a first means for applying a pretreatment agent to a cloth affixed on a vertical surface of a rigid erected body; the pretreatment agent being adapted to enhance the cleaning effect of a detergent, then applying the detergent to the cloth, and thereafter, sucking and removing the pretreatment agent, detergent and dirt from the cloth;

a second means wherein a pretreatment agent spraying device is used, which includes a pretreatment agent supplying pump of a motor operation type, so as to spray the pretreatment agent onto the cloth, and wherein thereafter the detergent is applied to the cloth, and subsequently all the pretreatment agent, detergent and dirt are sucked and removed from the cloth;

a third means for spraying the pretreatment agent onto the cloth, wherein a detergent applying/sucking device is used,which includes a detergent applying pump and sucking pump, both of which are of a motor operation type, so as to suck and remove the pretreatment agent, detergent and dirt from the cloth;

a fourth means wherein a pretreatment agent spraying device is used, which includes a pretreatment agent supplying pump of a motor operation type,so as to spray the pretreatment agent onto the cloth, and then a detergent applying/sucking device is used, which includes detergent applying pump an sucking pump, both of which are of a motor operation type, so as to suck and remove the pretreatment agent, detergent and dirt from the cloth;

a fifth means wherein a pretreatment agent spraying device is used, which includes a pretreatment agent supplying pump, a pretreatment agent spraying nozzle and a grip portion provided on the pretreatment agent spraying nozzle, so as to spray the pretreatment agent onto the cloth, and then, a detergent applying/sucking device is used, which includes a detergent applying pump of a motor operation type, a detergent applying nozzle, a sucking pump of a motor operation type, a sucking nozzle and a grip portion at which are provided those detergent applying nozzle and sucking nozzle, so to suck and remove the pretreatment agent, detergent and dirt from the cloth, and wherein an operator holds the grip portions respectively of the pretreatment agent spraying device and detergent applying/sucking device, in using those two devices;

a sixth means wherein a brightening agent is added in the detergent;

a seventh means wherein an alkaline chemical or agent is added in the detergent; and an eighth means comprising a cleaning device including a pretreatment agent applying means for applying a pretreatment agent to a cloth, a detergent applying means for applying the detergent to the cloth, and a sucking means for sucking and removing the pretreatment agent, detergent and dirt from the cloth.

The terms "pretreatment agent", "detergent", "brightener", and "alkaline agent" have their ordinary meaning as defined and used in dictionaries.

DETAILED DESCRIPTION OF THE INVENTION

With reference to the drawings, a specific description will be made of one embodiment of the present invention.

Figure 1:
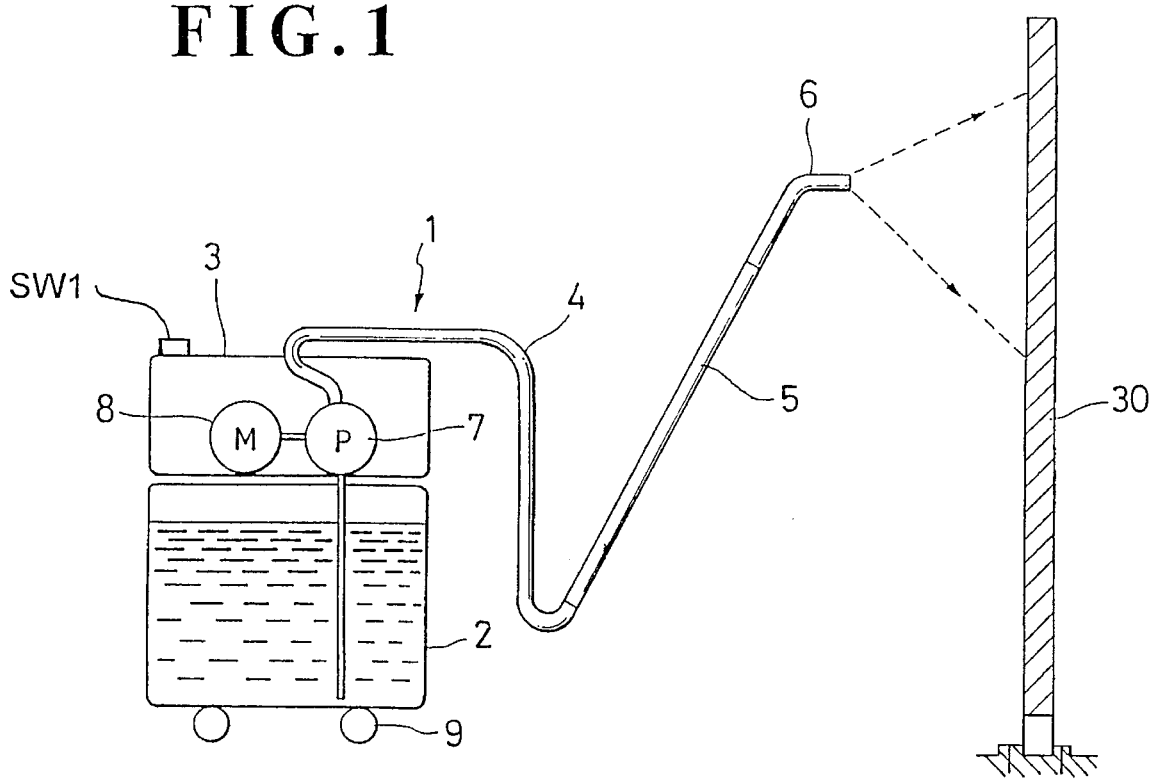
FIG. 1 is a schematic, longitudinally sectional view of one embodiment of pretreatment agent spraying device in accordance with the present invention and a partition.
Figure 4:
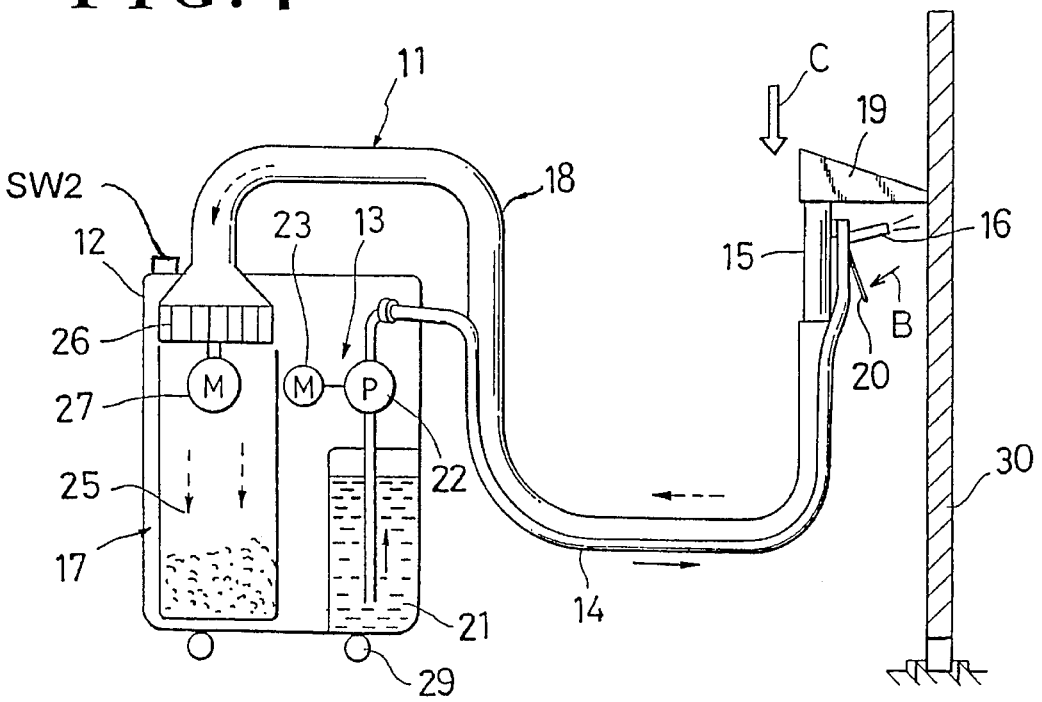
FIG. 4 is a schematic, longitudinally sectional view of one embodiment of detergent apply/sucking device in accordance with the present invention and the partition.

A cleaning device, as shown in the embodiment, comprises a pretreatment agent spraying device 1 as in FIG. 1 and a cleaning detergent applying/sucking device 11 as in FIG. 4. Although not designated, as can be seen from FIGS. 1 and 4, a pretreatment agent and a cleaning detergent, both of which are prepared in a liquid form, are respectively contained in those two separate devices. This will be explained later in more detail.

Figure 2:
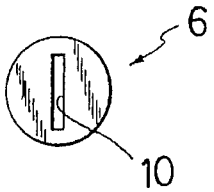
FIG. 2 is a front view of a pretreatment spraying nozzle of the device in FIG. 1.
Figure 3:
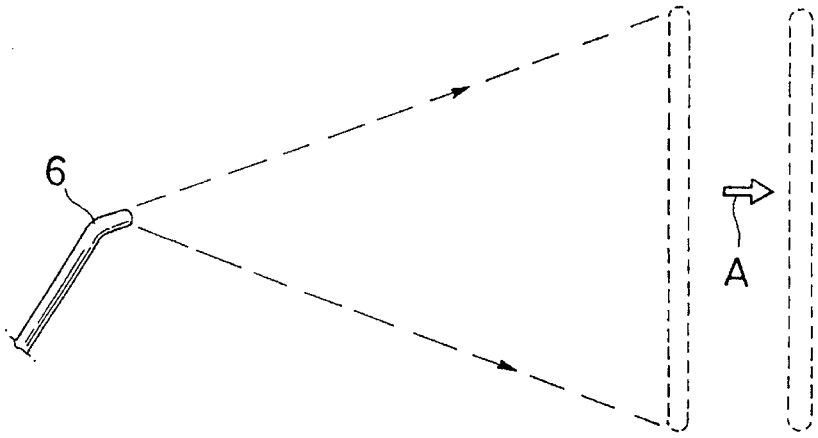
FIG. 3 is a schematic diagram showing the condition wherein the device in FIG. 1 is being operated.

FIG. 1 is a schematic, longitudinally sectional view of the pretreatment agent spraying device 1. FIG. 2 is a front view of a spraying nozzle 6 adapted for spraying a pretreatment agent onto a vertically erected body 30. FIG. 3 shows the state where spraying of the pretreatment agent is being effected onto the same body 30 by use of the pretreatment agent spraying nozzle 6.

Referring now to FIG. 1, the pretreatment agent spraying device 1 is comprised of a pretreatment agent tank 2 in which a pretreatment agent is contained, a pump chamber 3 attached upon the tank 2, a grip 5 which is in a flow communication with the pump chamber 3 via a hose 4, and the pretreatment agent spraying nozzle 6 provided on the grip 5.

The pump chamber 3 has, provided therein, a pump 7 for forcing out a pretreatment agent from the tank 2, the pump 7 being connected with the hose 4, and a motor 8 for driving the pump 7. Designation SW1 denotes a switch of any type currently available, which is electrically connected to the motor 8. Thus, turning on the switch SW1 causes the motor 8 to be operated so as to drive the pump 7, whereby the pretreatment agent in the tank 2 is drawn out by the pump 7 in a direction towards the nozzle 6.

The pump chamber 3 may be separated from the tank 2, allowing an operator to remove the chamber 3 from the tank 2 in order to fill a new round of pretreatment agent directly there into.

Designation 9 denotes a roller or caster.

As shown in FIG. 2, the spraying hole 10 of the nozzle 6 is formed in a generally vertical slit shape. Hence, the predetermined agent will be sprayed out therefrom so as to generally form a vertical rectilinear line upon the surface of erected body 30, as will be described later with reference to FIG. 3. In that case, the nozzle 6 should be displaced as indicated by the arrow A in FIG. 3.

Figure 6:
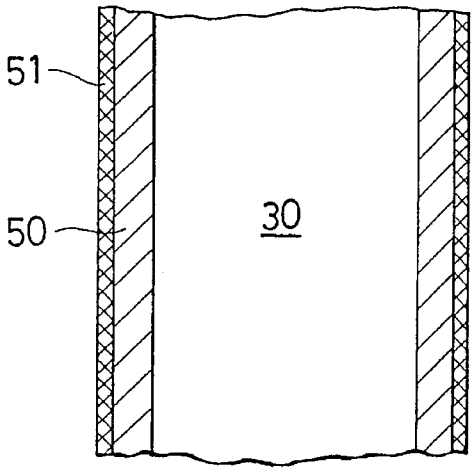
FIG. 6 is a partly broken, longitudinally sectional view of the partition.

It is noted that the foregoing pretreatment agent is an agent to be used firstly for pretreating a cloth (see designation 50 in FIG. 6) affixed on the erected body 30, so that the pretreated area of the cloth will be placed in a condition for making easier the absorption of the subsequent water-soluble cleaning detergent into that particular cloth area. According to the present invention, as a most effective pretreatment agent, it is preferred to use a solvent or mixture thereof which acts to destroy or dissolve an oil film or a fat film formed on the surface of the cloth 50, particularly a product named "B 108" produced by Professional Chemical Corporation, Chandler, Ariz. U.S.A. The pretreatment agent "B 108" contains a surface active agent as a base material and a small amount (i.e. at an amount harmless to a human body) of such organic solvent mixture as 2-butoxyethanol and 1,1,1-trichloroethane. It will be noted that 2-butoxyethanol is water soluble while 1,1,1-trichloroethane is water insoluble. A preferred solvent for the pretreatment agent is a solvent mixture comprising a water-soluble component and a water-insoluble component.

Figure 5:
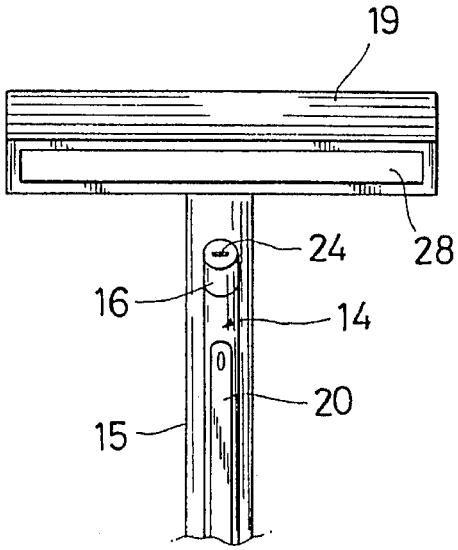
FIG. 5 is a partly broken front view of a detergent impinging nozzle and a sucking nozzle associated with the device in FIG. 2.

FIG. 4 is a schematic, longitudinally sectional view of the detergent applying/sucking device 11. FIG. 5 is a front view of the detergent applying nozzle 16 and detergent sucking nozzle 19.

As shown in FIG. 4, the detergent applying/sucking device 11 is comprised of a casing or housing 12, a detergent supply section 13 defined within the housing 12, a detergent applying nozzle 16 which is connected via a hose 14 to that detergent supply section 13 in a flow communication therewith, a negative-pressure suction section 17 defined within the housing 12, and a sucking nozzle 19 provided on a grip 15. The grip 15 is connected via a hose 18 to the negative-pressure suction section 17 in a flow communication therewith.

The detergent applying/sucking device 11 is operable to impinge or apply the cleaning detergent upon a soiled or stained area of the cloth 50, subsequent to the foregoing pretreatment agent having been sprayed thereon, and then suck all the detergent agent, pretreatment agent, and soil or dirt from the soiled are, to thereby clean them up. Accordingly, a higher cleaning effect can be attained by the present device 11 with regard to the cloth 50 affixed over the vertical surface of erected base body 30 made of rigid material, such as an office partition board or interior wall of room, in comparison with the conventional cleaning device which works to merely disperse the soil or dirt in the cloth. In that sense, the cleaning can be done in a sanitary condition, without causing any deterioration of the cloth for a long period of time. Further, there is no need to use the conventional forcible mechanical agitation method, and thus, the cloth being cleaned is also protected against any physical damage, since the cleaning does not involve raising the nap on the cloth. According to the device 11, a soiled or stained area of the cloth 51 is pretreated by the pretreatment agent B 108 to destroy an oil or fat film thereon, and then a detergent is applied to the thus-pretreated area of the cloth 51. Further, shortly after the application of detergent, substantially all of the pretreatment agent, detergent and soil or dirt can be sucked and removed from the cloth 51. It is thus possible for an operator to work on the cleaning in a short time with a great efficiency, without requiring an artisan having great skill or long experience. This enables an ordinary person to attain a good cleaning effect and also permits a much better cleaning effect to be achieved on a professional basis.

Designation 20 indicates a lever movably provided on the grip 15, which is electrically connected to the motor 23 and operable to cause the motor 23 to be driven to actuate the pump 22 so as to force out the detergent from a detergent tank 21 and spray out the same form the detergent applying nozzle 16. Namely, pressing the lever 20 in the direction of arrow B will allow a current to flow to the motor 23, thereby driving the same. Designation 29 denotes a roller or caster.

In the detergent supply section 13, there are arranged the detergent tank 21 containing a proper cleaning detergent, such as any water-soluble surface active agent available on the market, a pump 22 to which is connected the hose 14, and the detergent in the tank 21 is supplied by that pump 22 under a pressure, passing through the hose 14 in a direction outwardly thereof towards the detergent applying nozzle 16, and the motor 23 for driving the pump 22. Designation SW2 denotes a switch provided on the housing 12, which is electrically connected to the motor 27. Turning on this switch SW2 will operate the motor 27 to actuate a suction pump 26.

As shown in FIG. 5, the detergent applying nozzle 16 has an injecting hole 24 formed on its free end, which hole 24 is defined in a generally horizontally elongated slit shape. Thus, the detergent will be injected therefrom toward the outside, to generally form a horizontal rectilinear line, as will be described later.

In the negative-pressure suction section 17, there are arranged a soil or dust receiving part 25, the suction pump 26 having a rotary vane of a high-speed rotation type or the like, and the motor 27 for driving the pump 26.

The suction nozzle 19 has a suction hole 28 formed at its free end in a horizontally elongated slit shape, as illustrated.

It is to be understood that, as shown in FIG. 3, the above-mentioned pretreatment agent spray nozzle 6 should be manipulated by an operator such as to displace the vertically diverged stream of pretreatment agent being shot from the vertical slit shape of injecting hole 10, so that the pretreatment agent is dispersed over a soiled or stained area of the cloth 51 in a rectangular manner, and then, as shown in FIG. 4, the detergent supplying nozzle 16 with the suction nozzle 19 should be manipulated by the operator such as to displace the horizontally diverged stream of detergent being shot from the horizontal slit shape of injecting hole 24, so that all residual pretreatment agent, detergent and soil or dirt are sucked and removed from the soiled area. With this arrangement, it is possible to evenly complete spraying the pretreatment agent, applying the detergent, and removing the soil or dirt together with those pretreatment agent and detergent.

The spraying of detergent should be done as follows: An operator should hold, with his or her hand, the grip 5 associated with the nozzle 16, after which the operator has to hold another grip 15 associated with the detergent and suction nozzles 16 and 19 to apply the detergent to the cloth 50 and clean up the soil or dirt as well as both pretreatment agent and detergent. This effectively permits cleaning of the vertical surface of an erected body 30 such as the partition or wall, with more efficiency.

Now, a description will be given of the method for cleaning the surface of cloth (i.e, 51 in FIG. 6) using the aforementioned pretreatment agent spraying device 1 and detergent applying/sucking device 11, according to a sequential order of steps set forth below.

(I) At first, an operator should ascertain, with his or her eyes, the state of the cloth affixed over the partition board 30 (see FIGS. 1 and 4), for instance, in terms of the degree of soil, dirt, or stain thereupon. Then, a test should be conducted as to the type of the cloth; namely, how it is fabricated or woven, and also as to the discoloring or color fading degree of the same cloth. Depending on a result of this test, the operator should determine a ratio of ingredients of a cleaning detergent and if necessary, prepare another sort of detergent. However, in view of the nature of the cleaning of the present invention, it is recommended to normally prepare an ordinary water-soluble cleaning detergent. Also, as may be required, a proper brightening agent and/or an alkaline material should be added to the detergent, as an additive.

(11) Next, the pretreatment agent is sprayed mainly over an extremely soiled, dirty or stained are of the cloth, by turning on the switch SW1 of the pretreatment agent spraying device 1. (see FIG. 1)

In this regard, the operator should hold the grip 5 to direct the pretreatment agent, which is shot out from the spraying nozzle 6, towards the foregoing soiled or stained area.

Since the spraying hole 10 of such nozzle 6 is formed in a vertical slit shape as in FIG. 2, the pretreatment agent is shot out therefrom in a vertically divergent fashion to generally form a vertically elongated rectilinear stream, which is sprayed upon the cloth, as can be seen from FIG. 3. Also, as seen in FIG. 3, the operator should displace the nozzle 6 in a horizontal direction indicated by the arrow, to thereby form a rectangular sprayed zone of the pretreatment agent over the corresponding soiled or stained area of the cloth. Accordingly, the pretreatment agent is sprayed uniformly over the soiled or stained area of the cloth.

(111) Next, the thus-pretreated area of the cloth is cleaned by use of the detergent applying/sucking device 11 (see FIG. 4).

The operator should turn on the switch SW2 of the detergent applying/sucking device 11 to actuate the suction pump 26, causing the sucking action with respect to the sucking nozzle 19, and the, should hold the grip 15 to place the hole 28 of sucking nozzle 19 contact with the surface of cloth adjacent to the pretreated area thereof. Then, he or she should move the lever 20 in the direction of arrow B as shown in FIG. 4 to start operation of the pump 22 to cause the detergent to flow out from the hole 24 of detergent applying nozzle 16. Though not clearly shown, the detergent is shot therefrom in a horizontally divergent fashion, because of the horizontal slit shape of the hole 24, to generally form a horizontally elongated stream of detergent, which is impinged upon the surface of the cloth. It is essential here that such stream of detergent should reach the cloth, having a width equal to that of the hole 28 of sucking nozzle 19, so that the soil or dirt at the area of cloth, to which the detergent is being applied, may be fully sucked into the sucking nozzle hole 28. The detergent, when applied to the cloth, is quickly absorbed into the pretreated area of cloth due to the oil or fat destroying effect of the pretreatment agent, thus acting on the dirt or stain for decomposition thereof.

Then, the operator, while holding the grip 15, should slide the sucking nozzle 19 vertically as indicated by the arrow C in FIG. 4, along the surface of cloth. With this vertical movement, the detergent applying nozzle 16 integral with that sucking nozzle 19 is also naturally moved in the same vertical direction, applying thus the detergent upon the pretreated area of the cloth, and leaving, between those two nozzles 16 and 19, a small rectangular sprayed zone of detergent on that particular area. In such detergent sprayed zone, the soil, dirt or stain is decomposed by the detergent into a condition easy to be removed by the subsequent sucking operation of the sucking nozzle 19. In that way, those two nozzles 16 and 19 are manipulated to clean up the dirt together with the detergent.

In another embodiment of the present invention, a suitable brightening agent may be added in the detergent in order to avoid the luster reduction of the cloth which occurs due to the cleaning. A preferred brightening agent may be the product name "B 109" produced by the Professional Chemical Corporation, Chandler, Ariz., U.S.A., which comprises hydroxyacetic acid as an effective component in an amount harmless to a human body.

What is claimed is:

1. A method for effecting a cleaning, comprising the steps of:

applying a pretreatment agent to a soiled or stained part of a cloth which is affixed over a vertical surface of an erected body made of a rigid material, said pretreatment agent including a surface active agent and an organic solvent or mixture thereof and acting to destroy a film of an oil or fat formed on said soiled or stained part of said cloth, so as to pretreat said soiled or stained part;

then, applying a water-soluble cleaning detergent to the thus-pretreated part of said cloth, so as to decompose a soil or dirt therein, said water-soluble cleaning detergent including a surface active agent; and sucking and removing all of said pretreatment agent, said water-soluble cleaning detergent and said soil or dirt from said cloth.

2. A method for effecting a cleaning, comprising the steps of:

spraying a pretreatment agent onto a soiled or stained part of a cloth which is affixed over a vertical surface of an erected body made of rigid material, by use of a pretreatment agent spraying device, said pretreatment agent including a surface active agent and an inorganic solvent and acting to destroy a film or oil or fat formed on said soiled or stained part of said cloth, so as to pretreat said soiled or stained part;

then, spraying a water-soluble cleaning detergent onto the thus-pretreated part of said cloth, by use of a detergent spraying/sucking device, so as to decompose a soil or dirt in said part of said cloth, said water-soluble cleaning detergent including a surface active agent; and sucking and removing all of said pretreatment agent, said water-soluble cleaning detergent and said soil or dirt from said cloth, by use of said detergent spraying/sucking device.

3. The method as claimed in claim 1, wherein said method further comprises the steps of:

using a pretreatment agent spraying device, which includes a pretreatment agent supplying pump, a pretreatment agent spraying nozzle and a grip portion provided on said pretreatment agent spraying nozzle, so as to spray said pretreatment agent onto said cloth; and then, using detergent applying/sucking device, which includes a motor operated detergent applying pump, a detergent applying nozzle, a motor operated suction pump, a sucking nozzle and a grip portion at which are provided said detergent applying nozzle and sucking nozzle, so as to effect the last-mentioned steps of sucking and removing said pretreatment agent, said detergent and said dirt from said cloth, wherein an operator holds said grip portions respectively of said pretreatment agent spraying device and detergent applying/sucking device, in using those two devices.

4. The method for effecting a cleaning, comprising the steps of:

spraying a pretreatment agent onto a soiled or stained part of a cloth which is affixed over a vertical surface of an erected body made of rigid material, by use of a pretreatment agent spraying device, said pretreatment agent including a surface active agent and a small amount of inorganic solvent and acting to destroy a film of oil or fat formed on said soiled or stained part of said cloth, so as to pretreat said soiled or stained part;

then, spraying a water-soluble cleaning detergent onto the thus-pretreated part of said cloth, by us of a detergent spraying/sucking device, so as to decompose a soil or dirt in said part of said cloth; and sucking and removing all said pretreatment agent, said cleaning detergent and a soil or dirt from said cloth, by use of said detergent spraying/sucking device.

5. The method of claim 4, wherein said small amount of said organic solvent or mixture thereof comprises 2-butoxyethanol and 1,1,1-trichloroethane.

6. The method of claim 4, wherein the method further includes the steps of adding a brightening agent into said water-soluble cleaning agent, so as to avoid a luster reduction of said cloth which occurs due to the cleaning.

7. The method of claim 6, wherein said brightening agent includes phosphates.

8. The method of claim 4, wherein the method further includes the steps of adding an alkaline agent to said cleaning detergent, so as to enhance a cleaning effect of said detergent.

9. The method of claim 8, wherein said alkaline agent includes hydroxyacetic acid.

* * * * *